United States Patent [19]

Sharma

[11] Patent Number: 4,578,242

[45] Date of Patent: Mar. 25, 1986

[54] METALLOTHERMIC REDUCTION OF RARE EARTH OXIDES

[75] Inventor: Ram A. Sharma, Troy, Mich.

[73] Assignee: General Motors Corporation, Detroit, Mich.

[21] Appl. No.: 627,737

[22] Filed: Jul. 3, 1984

[51] Int. Cl.[4] ..... C22B 59/00; C22C 1/00

[52] U.S. Cl. ..... 420/590; 75/84; 75/129

[58] Field of Search ..... 75/84, 129; 420/590, 420/416, 513

[56] References Cited

U.S. PATENT DOCUMENTS

| | | | |
|---|---|---|---|
| 1,682,846 | 9/1928 | Kremers | 420/416 |
| 3,625,779 | 12/1971 | Cech | 148/101 |
| 3,748,193 | 7/1973 | Cech | 148/101 |
| 3,883,346 | 5/1975 | Martin | 75/0.5 BA |
| 3,928,089 | 12/1975 | Cech | 148/105 |

OTHER PUBLICATIONS

"Rare Earth Elements and Metals" Van Nostrand's Scientific Encyclopedia 5th ed., 1976, pp. 1886–1890.

*Primary Examiner*—Christopher W. Brody
*Attorney, Agent, or Firm*—Elizabeth F. Harasek

[57] ABSTRACT

Rare earth oxides can be reduced to rare earth metals by a novel, high yield, metallothermic process. The oxides are dispersed in a suitable, molten, calcium chloride bath along with sodium metal. The sodium reacts with the calcium chloride to produce calcium metal which reduces the rare earth oxides to rare earth metals. The metals are collected in a discrete layer in the reaction vessel.

21 Claims, 3 Drawing Figures

METALLOTHERMIC REDUCTION OF RARE EARTH OXIDES

This invention relates to a novel metallothermic process for the direct reduction of rare-earth oxide, particularly neodymium oxide, to rare earth metal. The method has particular application to low cost production of neodymium metal for use in neodymium-iron-boron magnets.

BACKGROUND

In the past, the strongest commercially produced permanent magnets were made from sintered powders of $SmCo_5$. Recently, even stronger magnets have been made from alloys of the light rare earth elements, preferably neodymium and praseodymium, iron and boron. These alloys and methods of processing them to make magnets are described in U.S. Ser. Nos. 414,936 (filed 9/3/82), 508,266 (filed 6/24/83) and 544,728 (filed 10/26/83) to Croat; 520,170 (filed 8/4/83) to Lee; and 492,629 (filed 5/9/83) to Croat and Lee, all assigned to General Motors Corporation.

Sources of the rare earth (RE) elements, atomic nos. 57 to 71 of the Periodic Chart as well as yttrium, atomic no. 39, are bastnaesite and monazite ores. Mixtures of the rare earths can be extracted from the ores by several well known beneficiating techniques. The rare earths can then be separated from one another by such conventional processes as elution and liquid-liquid extraction.

Once the rare earth metals are separated from one another, they must be reduced from the oxides to the respective metals in relatively pure form (95 atomic percent or purer depending on the contaminants) to be useful for permanent magnets. In the past, this final reduction was both complicated and expensive, adding substantially to the cost of rare earth metals.

Both electrolytic and metallothermic (non-electrolytic) processes have been used to reduce rare earths. The electrolytic processes include (1) decomposition of anhydrous rare earth chlorides dissolved in molten alkali or alkaline earth salts, and (2) decomposition of rare earth oxides dissolved in molten rare earth fluoride salts.

Disadvantages of both electrolytic processes include the use of expensive electrodes which are eventually consumed, the use of anhydrous chloride or fluoride salts to prevent the formation of undesirable RE-oxy salts (NdOCl, e.g.), high temperature cell operation (generally greater than 1000° C.), low current efficiences resulting in high power costs, low yield of metal from the salt (40% or less of the metal in the salt can be recovered). The RE-chloride reduction process releases corrosive chlorine gas while the fluoride process requires careful control of a temperature gradient in the electrolytic salt cell to cause solidification of rare earth metal nodules. An advantage of electrolytic processes is that they can be made to run continuously if provision is made to tap the reduced metal and to refortify the salt bath.

The metallothermic (non-electrolytic) processes include (1) reduction of RE-fluorides with calcium metal (the calciothermic process), and (2) reduction-diffusion of RE-oxide with calcium hydride or calcium metal. Disadvantages are that both are batch processes, they must be conducted in a non-oxidizing atmosphere, and they are energy intensive. In the case of reduction-diffusion, the product is a powder which must be hydrated to purify it before use. Both processes involve many steps. One advantage of metallothermic reduction is that the yield of metal from the oxide or fluoride is generally better than ninety percent.

Processes involving RE fluoride or chloride require pretreatment of the RE-oxide to create the halide. This additional step adds to the end cost of rare earth metals.

With the invention of light rare earth-iron permanent magnets, the demand for low cost, relatively pure, rare earth metals rose substantially. However, none of the existing methods of reducing rare earth compounds showed much promise for reducing the cost or increasing the availability of magnet-grade metals. Accordingly, it is an object of this invention to provide a new, efficient and less costly method of producing rare earth metals.

BRIEF SUMMARY

This and other objects may be accomplished in accordance with a preferred practice of the invention as follows.

A reaction vessel is provided which can be heated to desired temperatures by electrical resistance heaters or some other heating means. The vessel body is preferably made of a metal or refractory material that is either substantially inert or innocuous to the reaction constituents.

A predetemined amount of RE-oxide is charged into the reaction vessel containing a salt mixture of about 70 weight percent calcium chloride or greater and about 5 to 30 weight percent sodium chloride. Enough sodium metal is added to the salt mixture to form a stoichiometric excess of calcium metal with respect to the RE-oxide in accordance with the reaction $$CaCl_2 + 2Na \rightarrow 2NaCl + Ca.$$

The order in which the reaction constituents are added is not critical although Na metal should not be exposed to any unreacted water vapor carried into the reaction vessel by other constituents. It may be advantageous to add an amount of another metal such as iron or zinc to form a eutectic alloy with the reduced rare earth metal in order to obtain the RE metal product in a liquid state and to enable the reduction to be carried out at a lower temperature.

To run the reaction, the vessel is heated to a temperature above the melting point of the constituents (about 675° C) but below the vaporization temperature of sodium metal (about 900° C. in RE reduction reactions). The molten constituents are rapidly stirred in the vessel to keep them in contact with one another as the reaction progresses. The bath is replenished with $CaCl_2$ as necessary to maintain a weight percent of 70% of the combined weights of $CaCl_2$ and NaCl. While the reaction runs at $CaCl_2$ concentrations lower than 70%, the yield falls off rapidly. The calcium chloride serves not only as a source of calcium metal to reduce rare earth oxide, but also as a flux for the reduction reaction.

Several different and competing chemical reactions occur in the vessel, however the reduction of the RE-oxide is believed to be accomplished in accordance with the empirical reaction formula $$RE_nO_m + m\ Ca \rightarrow m\ CaO + n\ RE$$

where "n" and "m" are the number of moles of constituent and where the relation of n and m is determined by the oxidation state of the rare earth element. Metallic calcium for the reaction is produced by the reduction of the calcium chloride with the sodium metal.

The composite reaction is, therefore, $$RE_nO_m + m\ CaCl_2 + 2m\ Na \rightarrow n\ RE + mCaO + 2m\ NaCl.$$

For the reduction of neodymium oxide, the reaction would be $$Nd_2O_3 + 3\ CaCl_2 + 6\ Na \rightarrow 2\ Nd + 3\ CaO + 6\ NaCl.$$

The reduced metal has a density of about 7 grams/cc while that of the salt bath is about 1.9 grams/cc. When stirring is stopped, the reduced metal is recovered in a clean layer at the bottom of the reaction vessel. This layer may be tapped while molten or separated from the salt layer after it solidifies.

Thus, the subject method provides many advantages over prior art methods. It is carried out at a relatively low temperaure of about 700° C., particularly where the rare earth metal is recovered as a zinc or iron eutectic. It uses relatively inexpensive RE-oxide, $CaCl_2$ and Na metal reactants. It does not require pretransformation of RE-oxide to chloride or fluoride, nor the use of expensive Ca metal powder or $CaH_2$ reducing agent. Energy consumption is low because the method is not electrolytic and it is preferably carried out at atmospheric pressure at temperatures of about 700° C. The method can be practiced as either a batch or a continuous process, and the by-products of NaCl, $CaCl_2$ and CaO are easily disposed of. Moreover, the rare earth metals may be alloyed in the reaction vessel or may be alloyed later for use in magnets without further expensive purification treatments.

DETAILED DESCRIPTION

The objects and advantages of the invention will be better understood in view of the following detailed description and the figures in which.

Figure 1:
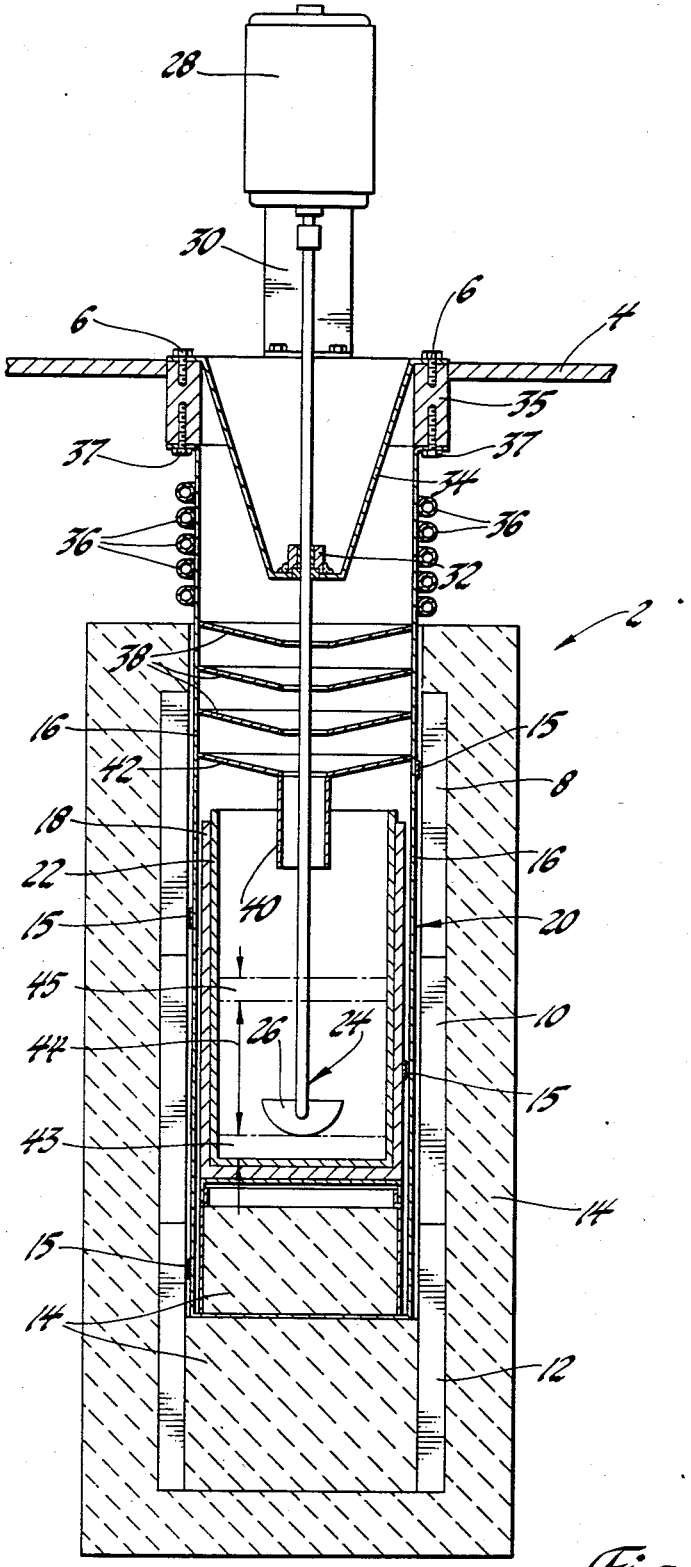
FIG. 1 is a schematic of an apparatus suitable for carrying out the subject method of reducing RE-oxides to RE metals.

This invention relates to an improved method of reducing compounds of rare earth elements to the metals. The rare earth metals include elements 57 through 71 of the periodic chart (scandium, lanthanum, cerium, praseodymium, neodymium, samarium, europium, gadolinium, terbium, dysprosium, holmium, erbium, thulium, ytterbium, lutetium) and atomic number 39, yttrium. The oxides of the rare earths are generally colored powders produced in the metals separation process. Herein, the term "light rare earth" refers to the elements La, Ce, Pr and Nd.

In the practice of this invention, the RE-oxides can generally be used as received from the separator but may be calcined to remove excess absorbed moisture or carbon dioxide. In the following examples, the RE-oxides were oven dried for about two hours at 1000° C. prior to use. The $CaCl_2$ and NaCl for the salt baths were reagent grade and dried for about two hours at 500° C. prior to use. In our initial work, care was taken to make sure that no moisture was introduced into the reaction vessel to prevent any hazardous reaction with the Na.

When $Nd_2O_3$ is mixed with $CaCl_2$ in a molten salt bath, oxychlorides are formed by the reaction $$Nd_2O_3 + CaCl_2 \rightarrow 2NdOce + Cao$$

The presence of such RE-oxy chlorides was known to reduce yield in prior art electrolytic processes so the presence of $Nd_2O_3$ was not tolerated. However, in the subject invention both RE-oxides and RE-oxy chlorides are both readily reduced by calcium metal. The formation of RE-oxy chlorides is advantageous because they float on reduced RE metals. RE-oxides, on the other hand, have densities close to the reduced RE metals so they may be retained as contaminants and make the metals unsuited for use in magnets. The metals I have reduced by my method have been substantially oxide-free.

Unalloyed Nd metal has a melting temperature of about 1025° C. The other rare earth metals also have high melting points. If one wanted to run the subject reaction at such temperatures, it would be possible to do so and obtain pure metal at high yields. However, it is preferred to add amounts of other metals such as iron, zinc, or other non-rare earth metals to the reduction vessel in order to form an alloy with the recovered rare earth metal that is lower melting. For example, iron forms a low melting eutectic with neodymium (11.5 weight percent Fe; m.p. about 640° C.) as does zinc (11.9 weight percent Zn, m.p. about 630° C.). If sufficient iron is added to a $Nd_2O_3$ reduction system, the reduced metal will form a liquid pool at about 640° C. A Nd-Fe eutectic alloy may be directly alloyed with additional iron and boron to make magnets having the optimum $Nd_2Fe_{14}B$ magnetic phase described in the U.S. Serial Nos. cited above.

If it is preferred to lower the melting point of the recovered rare earth metal but not retain the metal added to do so, a metal with a boiling point much lower than the boiling point of the recovered rare earth can be added to the reaction vessel. For example, Zn boils at 907° C. and Nd boils at 3150° C. The low-melting metal can then be readily separated from the rare earth metal by simple distillation.

Materials used for reaction vessels should be chosen carefully because of the corrosive nature of molten rare earth metals, particularly rare earth metals retained in a salt flux environment. Yttria lined alumina and boron nitride are non-reactive, refractory materials generally acceptable. It is also possible to use a refractory vessel made of a substantially inert metal such as tantalum or a consumable but inocuous metal such as iron. An iron vessel could be used to contain reduced RE metal and then be alloyed with the RE for use in magnets.

Calcium is the only metal that has been used commercially to reduce rare earth element compounds in the past, and then the oxide only by the expensive, reduction-diffusion process. It would be much less costly to use sodium metal as the reductant for rare earth oxides suspended in a liquid phase. However, the rare earth oxides are more chemically stable than sodium oxide, i.e. the free energies of the rare earth oxide-sodium metal reduction reactions are positive.

In accordance with this invention, I have discovered a new method of using sodium metal to reduce rare earth oxides. The method entails reducing calcium chloride, a relatively inexpensive compound, with sodium metal according to the reaction $$CaCl_2+2Na \rightarrow 2NaCl+Ca.$$

Once calcium metal is produced, it is necessary to bring it into physical contact with the RE-oxide to cause the reaction $$RE_nO_m+m\ Ca \rightarrow n\ RE+m\ CaO.$$

The complete reaction formula, discounting any intermediate products which may be formed, is $$RE_nO_m+m\ CaCl_2+2m\ Na \rightarrow n\ RE+CaO+2m\ NaCl.$$

This reaction has a negative free energy at all temperatures where the reaction constituents are in a liquid state. Unless the reaction vessel is pressurized, it is desirable to keep the temperature below about 910° C. to prevent sodium metal from boiling out of solution. It is preferred to run the reactions at atmospheric pressure because of the added difficulty of using pressurized equipment.

The most preferred range of operating temperatures is between about 650° C. and 800° C. At such temperatures the loss of Na metal is not a serious problem nor is wear on the reaction vessel. This temperature range is suitable for reducing $Nd_2O_3$ to Nd metal because the Nd-Fe and Nd-Zn eutectic temperatures are below 700° C. Moreover, at about 700° C. the solublitiy of Ca metal in the salt bath is about 1.3 molecular percent. This is sufficient to rapidly reduce RE-oxide to metal. Higher operating temperatures are alright, but there are many advantages of operating at lower temperatures.

Where good separation of reduced metal from the flux is needed, the reaction temperature must be above the melting point of the reduced metal or the melting point of the reduced metal alloyed or coreduced with another metal. These relatively dense RE metals and alloys collect at the bottom of the reaction vessel when allowed to settle. There they can be tapped while molten or removed after solidification. Table I shows the molecular weight (m.w.), density in grams per cubic centimeter at 25° C., melting point (m.p.) and boiling point (b.p.) for elements and compounds used in the subject invention.

TABLE I

| | m.w. | $\mu$ | m.p. (°C.) | b.p. (°C.) |
|---|---|---|---|---|
| Nd | 144.24 | 7.004 | 1024 | 3300 |
| $Nd_2O_3$ | 336.48 | 7.28 | 1900 | — |
| NdOCl[b] | 195.69 | 5.50 | | |
| Ca | 40.08 | 1.55 | 850 | 1494 |
| CaO | 56.08 | 3.25 | 2927 | 3500 |
| Na | 22.99 | 0.968 | 97.82 | 881 |
| Fe | 55.85 | 7.86 | 1537 | 2872 |
| Zn | 65.37 | 7.14 | 419.6 | 911 |
| $CaCl_2$ | 110.99 | 2.15 | 772 | 1940 |
| NaCl | 58.45 | 2.164 | 801 | 1465 |
| 55 m/o $CaCl_2$— 45 m/o NaCl | | 1.903* | | |
| NaCl | | 1.596* | | |
| $CaCl_2$ | | 2.104* | | |

[b]Calculated
*AT 1000 K

FIG. 1 shows the apparatus suitable for the practice of the invention in which the experiments set out in the several examples were conducted.

All experiments were carried out in a furnace well 2 having an inside diameter of 12.7 cm and a depth of 54.6 cm mounted to the floor 4 of a dry box with bolts 6. A helium atmosphere containing less than one part per million each $O_2$, $N_2$ and $H_2O$ was maintained in the box during experimentation.

The furnace was heated by means of three tubular, electric, clamshell heating elements 8, 10 and 12 having an inside diameter of 13.3 cm and a total length of 45.7 cm. The side and bottom of the furnace well were surrounded with refractory insulation 14. Thermocouples 15 were mounted on the outer wall 16 of furnace well 20 at various locations along its length. One of the centrally located thermocouples was used in conjunction with a proportional band temperature controller (not shown) to automatically control center clamshell heater 10. The other three thermocouples were monitored with a digital temperature readout system and top and bottom clamshell heaters 8 and 12 were manually controlled with transformers to maintain a fairly uniform temperature throughout the furnace.

The reduction reactions were carried out in a reaction vessel 22 retained in a stainless steel crucible 18 having a 10.2 cm outer diameter 12.7 cm deep and 0.15 cm thick retained in stainless steel furnace well 20. Reaction vessel 22 was made of tantalum metal unless otherwise noted in the examples.

A tantalum stirrer 24 was used to agitate the melt during the reduction process. It had a shaft 48.32 cm long and a welded blade 26. The stirrer was powered by a 100 W variable speed motor 28 capable of operating at speeds up to 700 revolutions per minute. The motor was mounted on a bracket 30 so that the depth of the stirrer blade in the reaction vessel could be adjusted. The shaft was journaled in a bushing 32 carried in an annular support bracket 34. The bracket is retained by collar 35 to which furnace well 20 is fastened by bolts 37. Chill water coils 36 were located near the top of well 20 to promote condensation and prevent escape of volatile reaction constituents. Cone shaped stainless steel baffles 38 were used to reflux vapors, and prevent the escape of Na and Ca. Reflux products drop through tube 40 on bottom baffle 42.

When the constituents in the furnace are not stirred they separate into layers with the rare earth alloy pool 43 on the bottom, the RE-oxy chloride, calcium/-sodium chloride salt bath 44 above that and any unreacted sodium and calcium metals 45 above that.

Figure 2:
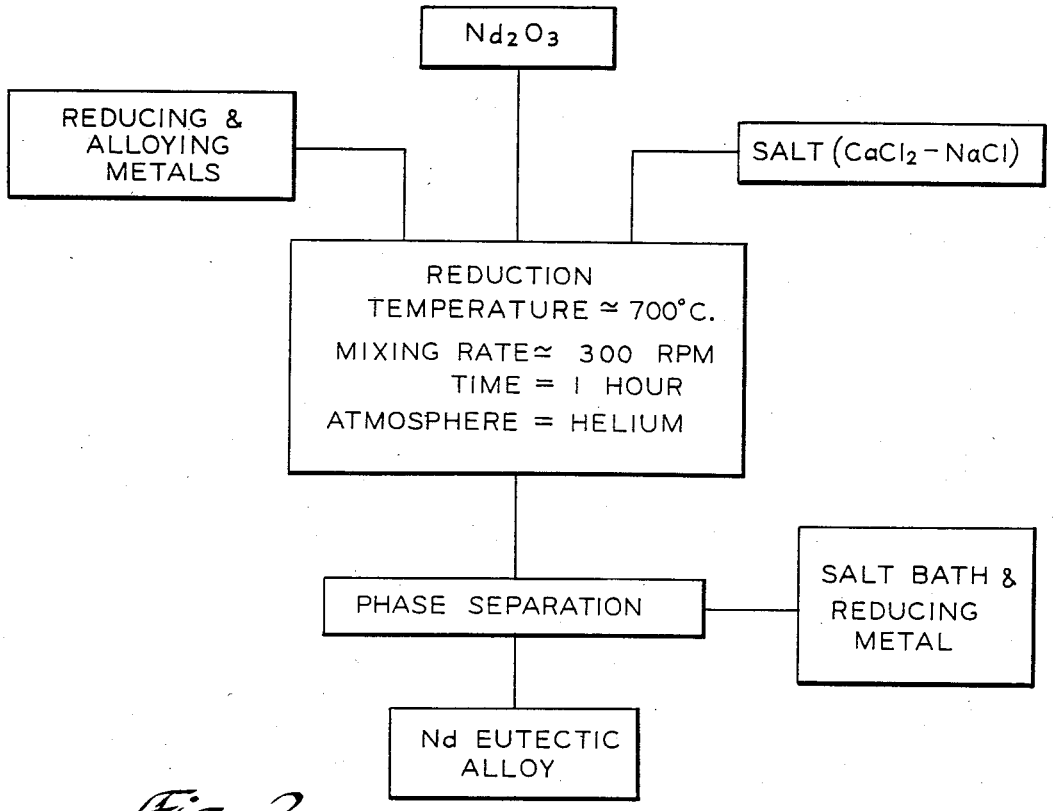
FIG. 2 is a flow chart for the reduction of $Nd_2O_3$ to yield a neodymium-eutectic alloy.

FIG. 2 is an idealized flow chart for the reduction of $Nd_2O_3$ to Nd metal in accordance with this invention. The $Nd_2O_3$ is added to the reaction vessel along with calcium and sodium chlorides in suitable proportions. Sodium and/or calcium metal and enough of a eutectic forming metal such as iron or zinc to form a near eutectic Nd alloy are added. The reaction is run, with rapid stirring at about 300 revolutions per minute for reduction for one hour and with slow stirring at about 60 revolutions per minute for one hour for reduced metal recovery in the pool at a temperature of about 700° C. Preferably, a blanket of an inert gas such as helium is maintained over the reaction vessel. After substantially all the $Nd_2O_3$ has been reduced by the Ca metal produced either by the reaction of Na and $CaCl_2$ or added Ca metal, slow stirring at about 60 revolutions per minute is continued to allow the rare earth metal to settle. Stirring is then stopped and the constituents are maintained at a suitable elevated temperature to allow the various liquids in the vessel to stratify. The reduced Nd eutectic alloy collects at the bottom because it has the highest density. The remaining salts and any unreacted Ca and Na metal collect above the Nd alloy and can be readily broken away after the vessel has cooled and the constituents have solidified. Nd alloys so produced can be alloyed with additional elements to produce permanent magnet compositions. These magnet alloys may be processed by melt-spinning or they can be ground and processed by powder metallurgy to make magnets.

EXAMPLE I

Because small batches (200 grams or less) of rare earth metal were originally produced from the oxide, a small pool of the desired end product was first alloyed at the bottom of the reaction vessel so that enough ingot would be produced to provide meaningful data. However, it is not necessary to use such a "seed" pool to carry out the subject reactions.

265 grams of 99% pure Nd metal chunks and 35 grams of 99.9% purity Zn metal were placed in the reaction vessel to make 300 grams (43 $cm^3$) of near eutectic alloy. The vessel was lowered into the furnace well in the floor of the dry box and heated to 800° C. to alloy the Nd and Zn.

The furnace temperature was lowered to about 700° C. 93 grams (1.6 moles, 58 $cm^3$) of NaCl, 835 grams (7.5 moles, 398 $cm^3$) of $CaCl_2$ and 117 grams (0.35 moles, 16 $cm^3$) of $Nd_2O_3$, enough to yield approximately 100 grams Nd metal at a 100% recovery efficiency, were added to the crucible. This created a salt bath of 90 weight percent $CaCl_2$ and 10 weight percent NaCl. 71.8 grams (3.1 moles) of Na metal were added to the crucible and it was stirred at a rate of 300 revolutions per minute for thirty minutes.

After 30 minutes, an additional 260 grams (2.4 moles) of $CaCl_2$, 14.28 grams of Zn metal, 117 grams of $Nd_2O_3$ and 71.5 grams Na metal were added. Stirring was continued for another thirty minutes at 300 rpm. The mixture was retained at about 700° C. for another hour and the stirring rate was decreased to about 60 revolutions per minute.

If all the Na present in the reaction crucible (142.8 grams; 6.2 moles) were to react with $CaCl_2$, 3.1 moles of Ca metal could be produced by the reaction $$CaCl_2 + 2Na \rightarrow 2NaCl + Ca.$$

The total amount of $Nd_2O_3$ present was 232 grams or 0.7 moles. Since it takes 3 moles of Ca metal to reduce one mole of $Nd_2O_3$ to produce 2 moles of Nd metal, theoretically only 2.1 moles of calcium would be necessary to reduce 0.7 moles $Nd_2O_3$. However, it is preferred to run the reaction with an excess of calcium.

After two hours, the stirrer was carefully removed and the crucible was placed on the floor of the drybox to cool. Excess Na and Ca metal formed a puddle on top of the other constituents. As the liquid in the crucible solidified a layer of clean looking Nd-Zn eutectic alloy formed on the bottom. This layer was carefully separated from the salt layer above it. Chemical analysis showed its neodymium content to be 181.83 grams (not including the 265 grams neodymium from the original seed pool), which is a yield of about 90.5% based on a theoretical yield of 200 grams. The zinc was separated by vacuum distillation.

EXAMPLE II 265 grams of 99% pure Nd metal chunks and 50 grams of 99.9% purity Zn metal were placed in a tantalum crucible to make 315 grams of near eutectic alloy. The crucible was lowered into the furnace well and heated to 800° C. to alloy the Nd and Zn.

The furnace temperature was lowered to about 20° C. 150 grams of NaCl and 350 grams of $CaCl_2$ were added to create a salt bath of 70 weight percent CaC12. 234 grams (0.7 moles) of $Nd_2O_3$ were added. 104 grams of Ca (2.6 moles) metal were added to the crucible and it was stirred at a rate of 300 revolutions per minute for about two hours and then for another hour at a stirring rate of 60 revolutions per minute. The crucible was removed from the furnace and cooled on the floor of the drybox.

189 grams of Nd metal (not including the 265 grams neodymium from the original seed pool) of purity greater than 99% was recovered by distilling the Nd-Zn alloy collected at the bottom of the liner. The yield of Nd metal from the oxide was about 94%.

In this example, calcium metal reductant was added to the salt bath in lieu of sodium. Although calcium is generally more expensive than sodium, it may sometimes be the reductant of choice because sodium can be more difficult to handle.

EXAMPLE III 350 grams of 99% pure Nd metal chunks and 64 grams of electrolytic iron were placed in a 6 mm thick mild steel reaction vessel to make 414 grams of near eutectic alloy. The steel vessel was lowered into the furnace well and heated to 800° C. to alloy the Nd and iron.

The furnace temperature was lowered to about 720° C. 300 grams of NaCl and 700 grams of $CaCl_2$ were added to create a salt bath of 70 weight percent $CaCl_2$. 117 grams (0.35 moles) of $Nd_2O_3$ were added. 46 grams of (1.15 moles) Ca metal and 10.8 grams (0.47 moles) of Na were added to the crucible and it was stirred at a rate of 300 revolutions per minute for about 135 minutes. At this point an additional 117 grams (0.35 moles) of $Nd_2O_3$, 46 grams (1.15 moles) of Ca metal and 10.8 grams (0.47 moles) of Na were added. The reactants were stirred for another 114 minutes at 300 rpm and then for another hour at a stirring rate of 60 rpm. The liner was removed from the furnace and cooled on the floor of the drybox. A Ca-Na metal melt formed on top of the salt layer.

594 grams of 97% purity Nd-Fe alloy were recovered. Such alloy could be combined directly as recovered with additional iron and boron to make the ideal Nd-Fe-B alloy for permanent magnet manufacture.

EXAMPLE IV

Table II sets out the amounts of various constituents used in the metallothermic reduction of about 234 grams of $Nd_2O_3$ with Ca metal using the process set out in Example II except that the reactants were stirred for four hours at 300 revolutions per minute followed by an additional hour of stirring at 60 rpm.

TABLE II

| Sample No. | $CaCl_2$ (w/o) | NaCl (w/o) | Total Salt (g) | Ca (g) | Na (g) | Nd in Eutectic (w/o) | Nd Produced (g) | Nd Yield (%) |
|---|---|---|---|---|---|---|---|---|
| 1* | 65.5 | 34.5 | 740 | 66.7 | — | 88.9 | 65.2 | 65.2 |

TABLE II-continued

| Sample No. | $CaCl_2$ (w/o) | NaCl (w/o) | Total Salt (g) | Ca (g) | Na (g) | Nd in Eutectic (w/o) | Nd Produced (g) | Nd Yield (%) |
|---|---|---|---|---|---|---|---|---|
| 2 | 90 | 10 | 786 | 91.7 | — | 88.2 | 170.5 | 85.3 |
| 3 | 90 | 10 | 1178 | 104.2 | — | 90.2 | 195.7 | 97.8 |
| 4 | 75 | 25 | 1116 | 91.7 | 20.5 | 89.7 | 194.9 | 97.5 |
| 5 | 60 | 40 | 1066 | 91.7 | 20.8 | 88.2 | 99.1 | 49.5 |
| 6 | 70 | 30 | 1098 | 91.6 | 20.8 | 89.2 | 192.2 | 96.1 |

*117 grams $Nd_2O_3$

Figure 3:
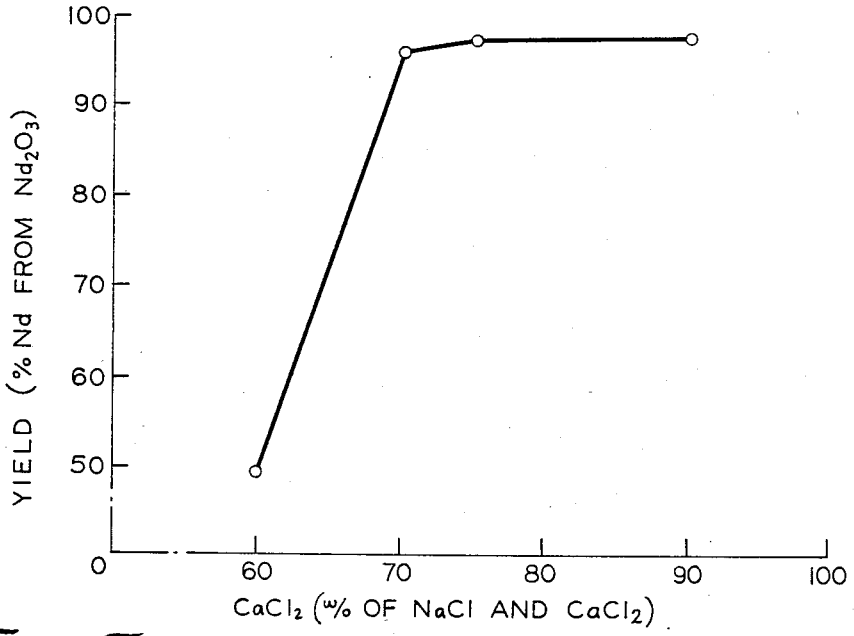
FIG. 3 is a plot of Nd metal yield from $Nd_2O_3$ as a function of the the percent $CaCl_2$ in the flux bath.

At a salt bath ratio of 60 weight percent $CaCl_2$ and 40 weight percent NaCl, the yield of Nd metal was only 49.5%. At 65.5 w/o $CaCl_2$ and 34.5 w/o NaCl, the yield increases to 65.2%. At 70 w/o $CaCl_2$ or more, the Nd yield in each case is greater than 85% and generally over 95%. FIG. 3 is a plot of Nd metal yield from $Nd_2O_3$ as a function of the weight percent $CaCl_2$ in a two component NaCl-$CaCl_2$ starting salt bath. Referring to Table II and FIG. 3, I have found that to obtain high yields, it is necessary to maintain the amount of $CaCl_2$ in the salt bath above about 70 weight percent of the total $CaCl_2$ and NaCl salt flux. It is also desirable to have a salt to RE-oxide volume ratio of at least about 2:1 to provide adequate flux for the dispersion of the RE-oxide. I have observed that as the volume ratio of the salt bath to RE-oxide increases, the rate of stirring may be decreased to obtain similar yields in a given period of time. The $CaCl_2$ containing bath is a significant feature of this invention.

Several of the samples were combined and the Zn metal was removed by vacuum distillation. The resultant alloy was analyzed and was found to be of greater than 99% purity with 0.4% aluminum, 0.1% silicon, 0.01% calcium and traces of zinc, magnesium and iron contamination. The Nd metal so produced was melted in a vacuum furnace with electrolytic iron and ferroboron to produce an alloy having the nominal composition $Nd_{0.15}B_{0.05}Fe_{0.80}$. The alloy was melt spun as described in U.S. Ser. No. 414,936 cited above to produce very finely crystalline ribbon with an as-quenched coercivity of about 10 megaGaussOersteds.

While the invention has been described in detail for the reduction of $Nd_2O_3$, it has equal applicability to reducing other single rare earth element oxides or combinations of rare earth oxides. This is due to the fact that CaO is more stable than the oxides of any of the rare earths. While one skilled in the art could have made a determination of the relative free energies of RE-oxides and CaO in the past, before this invention it was not known that RE-oxides could be reduced by Ca metal in a non-electrolytic, liquid phase process. U.S. Ser. No. 627,736, now abandoned, also to Sharma and filed on July 3, 1984, relates specifically to the use of calcium metal as the rare earth oxide reducing agent and is incorporated herein by reference. Oxides of transition metals such as Fe and Co can be co-reduced with RE-oxides by the subject process if desired.

In summary, I have developed a new, efficient and less costly method of reducing rare earth oxides to rare earth metals. It entails the formation of a suitable, molten $CaCl_2$ based bath in which rare earth oxide is stirred with a stoichiometric excess of Na and/or Ca metal. When stirring is stopped, the components settle into discrete layers which can be broken apart when they cool and solidify. In the alternative, the reduced rare earth metal can be tapped from the bottom of the reaction vessel. After the metal is tapped, the bath can be refortified to run another batch making the process a substantially continuous one.

While my invention has been described in terms of specific embodiments thereof, other forms may be readily adapted by those skilled in the art. Accordingly, the scope of the invention is to be limited only by the following claims.

The embodiments of the invention in which an exclusive property or privilege is claimed are defined as follows:

1. A non-electrolytic method of reducing rare earth oxide to rare earth metal comprising forming a molten salt bath comprised of calcium chloride; adding a volume of rare earth oxide less than the volume of the molten salt to said bath; adding an amount of sodium to said bath sufficient to form a stoichiometric excess of calcium metal based on the amount of rare earth oxide therein by the reaction $$CaCl_2 + 2\ Na \rightarrow Ca + 2\ NaCl$$

and maintaining said bath in a molten state and agitating it such that the calcium metal reduces the rare earth oxide to rare earth metal.

2. A non-electrolytic method of reducing neodymium oxide to neodymium metal comprising forming a molten salt bath comprised of calcium chloride; adding a volume of neodymium oxide less than the volume of the molten salt to said bath; adding an amount of sodium to said bath sufficient to form a stoichiometric excess of calcium metal based on the amount of rare earth oxide therein by the reaction $$CaCl_2 + 2\ Na \rightarrow Ca + 2\ NaCl$$

and maintaining said bath in a molten state and agitating it such that the calcium metal reduces the neodymium oxide to neodymium metal.

3. A non-electrolytic method of reducing rare earth oxide to rare earth metal comprising forming a molten salt bath comprised of at least about 70 weight percent calcium chloride; adding an amount of rare earth oxide up to about half the molten salt volume to said bath; adding an amount of sodium to said bath sufficient to form a stoichiometric excess of calcium metal based on the amount of rare earth oxide therein by the reaction $$CaCl_2 + 2\ Na \rightarrow Ca + 2\ NaCl;$$

maintaining said bath in a molten state and agitating it such that the calcium metal reduces the rare earth oxide to rare earth metal; stopping agitation such that a discrete layer containing the rare earth metal is formed.

4. The method of claim 3 wherein the rare earth oxide is one or more rare earth oxides taken from the group consisting of lanthanum oxide, cerium oxide, praseodymium oxide and neodymium oxide.

5. A method of reducing $Nd_2O_3$ to Nd metal comprising the steps of forming a molten bath of at least about 70 weight percent $CaCl_2$ and the balance NaCl; adding a volume of $Nd_2O_3$ to the bath which is less than about 50% of the volume of the molten bath; adding an amount of sodium metal to the bath sufficient to create a stoichiometric excess of calcium metal based on the amount of $Nd_2O_3$ in the bath by the reaction $$CaCl_2+2\ Na \rightarrow Ca+2\ NaCl;$$

maintaining the bath at a temperature above its melting temperature but lower than the boiling temperature of sodium metal therein; stirring said bath such that the constituents are mixed with one another and continuing such stirring until a substantial portion of the $Nd_2O_3$ is reduced to Nd metal; discontinuing stirring while maintaining the constituents in a molten state such that a discrete layer containing the reduced rare earth metal, substantially free of $Nd_2O_3$ oxide inclusions, is formed.

6. A method of reducing one or more rare earth oxides to rare earth metal comprising the steps of forming a molten bath of $CaCl_2$ and optionally NaCl, the relative amounts of $CaCl_2$ to NaCl being such that the yield of rare earth metal from rare earth oxide is at least about 90 percent; adding a volume of rare earth oxide to the bath which is less than about 25 percent of the volume of the molten bath; adding an amount of sodium metal to the bath sufficient to create a stoichiometric excess of calcium metal based on the amount of rare earth oxide in the bath by the reaction $$CaCl_2+2\ Na \rightarrow Ca+2\ NaCl;$$

maintaining the bath at a temperature above its melting temperature but lower than the boiling temperature of sodium metal therein; stirring said bath such that the constituents are mixed with one another and continuing such stirring until a substantial portion of the rare earth oxide is reduced to rare earth metal; discontinuing stirring while maintaining the constituents in a molten state such that a discrete layer containing the reduced rare earth metal is formed.

7. A method of making an alloy of one or more rare earth elements and iron comprising forming a molten salt bath comprised of at least about 70 percent calcium chloride and from about 0 to 30 weight percent sodium chloride; adding a volume of rare earth oxide to said bath which is less than the volume of the molten salt; adding an amount of sodium and/or calcium to said bath sufficient to form a stoichiometric excess of calcium metal based on the amount of rare earth oxide therein; maintaining said bath in a molten state and agitating it such that the calcium metal reduces the rare earth oxide to rare earth metal; adding an amount of iron to said bath sufficient to form an iron-rare earth alloy having a melting temperature substantially lower than the melting temperature of the rare earth metal; and stopping agitation such that the rare earth metal-iron alloy collects in a discrete layer.

8. The method of claim 7 wherein the rare earth oxide is one or more rare earth oxides taken from the group consisting of lanthanum oxide, cerium oxide, praseodymium oxide and neodymium oxide.

9. The method of claim 7 wherein the rare earth oxide is neodymium oxide.

10. A method of making an alloy of one or more rare earth elements and zinc comprising forming a molten salt bath comprised of at least about 70 weight percent calcium chloride and from about 0 to 30 weight percent sodium chloride; adding an amount of rare earth oxide to said bath which is less than the volume of the molten salt; adding an amount of sodium and/or calcium to said bath sufficient to form a stoichiometric excess of calcium metal based on the amount of rare earth oxide therein; maintaining said bath in a molten state and agitating it such that the calcium metal reduces the rare earth oxide to rare earth metal; adding an amount of zinc to said bath sufficient to form a rare earth-zinc alloy with a melting temperature substantially lower than the melting temperature of the rare earth metal; and stopping agitation such that the rare earth-zinc alloy collects in a discrete layer.

11. The method of claim 10 wherein the rare earth oxide is one or more rare earth oxides taken from the group consisting of lanthanum oxide, cerium oxide, praseodymium oxide and neodymium oxide.

12. The method of claim 10 wherein the rare earth oxide is neodymium oxide.

13. A method of making a low-melting alloy of one or more rare earth elements and one or more non-rare earth metals comprising forming a molten salt bath comprised of at least about 70 weight percent calcium chloride and from about 0 to 30 weight percent sodium chloride; adding an amount of rare earth oxide to said bath which is less than the volume of the molten salt; adding an amount of sodium and/or calcium to said bath sufficient to form a stoichiometric excess of calcium metal based on the amount of rare earth oxide therein; maintaining said bath in a molten state and agitating it such that the calcium metal reduces the rare earth oxide to rare earth metal; adding an amount of non-rare earth metal to said bath sufficient to form a rare earth/non-rare earth metal alloy with a melting temperature substantially lower than the melting temperature of the rare earth metal; and stopping agitation such that the rare earth/non-rare earth metal alloy collects in a discrete layer.

14. The method of claim 13 wherein the rare earth oxide is one or more rare earth oxides taken from the group consisting of lanthanum oxide, cerium oxide, praseodymium oxide and neodymium oxide.

15. The method of claim 13 wherein the non-rare earth metal is iron or zinc.

16. A metallothermic method of reducing rare earth oxide to rare earth metal by forming a molten salt bath comprised predominantly of calcium chloride, dispersing a lesser volume of rare earth oxide than the salt bath volume in the bath, adding a stoichiometric excess of sodium metal with respect to the amount of rare earth metal ion to the bath and agitating said bath such that the oxide is reduced to rare earth metal in accordance with the reaction formula $$RE_nO_m+m\ CaCl_2+2m\ Na \rightarrow n\ RE+m\ CaO+2m\ NaCl$$

where RE represents one or more rare earth elements having a valence in the oxide of 2, 3 or 4, and where n and m are integers such that the valence of the RE multiplied by n equals m multiplied by the valence of oxygen.

17. A metallothermic method of reducing neodymium oxide to neodymium metal by forming a molten salt bath comprised predominantly of calcium chloride, dispersing a lesser volume of neodymium oxide than the salt bath volume to the bath, adding a stoichiometric excess of sodium metal with respect to the amount of neodymium metal ion to the bath and agitating said bath such that the oxide is reduced to rare earth metal in accordance with the reaction formula $$Nd_2O_3+3\ CaCl_2+6\ Na \rightarrow 2\ Nd+3\ CaO+6\ NaCl.$$

18. A metallothermic method of reducing rare earth oxide to rare earth metal comprising forming a molten salt bath comprised predominantly of calcium chloride, dispersing a volume of rare earth oxide less than half the volume of the molten salt in the bath, adding a stoichiometric excess of sodium and/or calcium metal with respect to the amount of rare earth metal ion to the bath and agitating the molten bath such that a substantial portion of the rare earth oxide is reduced to rare earth metal.

19. A metallothermic method of reducing rare earth oxide to rare earth metal comprising forming a molten salt bath comprised predominantly of calcium chloride, dispersing a volume of rare earth oxide less than half the bath volume of the molten salt in the bath, adding a stoichiometric excess of sodium and/or calcium metal with respect to the amount of rare earth metal ion to the bath, agitating the molten bath such that a substantial portion of the rare earth oxide is reduced to rare earth metal and discontinuing agitation such that the reduced rare earth metal collects in a discrete layer.

20. A metallothermic method of reducing rare earth oxide to rare earth metal by forming a molten salt bath comprised predominantly of calcium chloride, dispersing a lesser volume of rare earth oxide than the salt bath volume in the bath, adding a stoichiometric excess of calcium metal with respect to the amount of rare earth metal ion to the bath and agitating said bath such that the oxide is reduce to rare earth metal in accordance with the reaction formula $$Re_nO_m+MCa \rightarrow n\ RE+m\ CaO$$

where RE represents one or more rare earth elements having a valence in the oxide 2, 3 or 4, and where n and m are integers such that the valence of the RE multiplied by n equals m multiplied by the valence of oxygen.

21. A metallothermic method of reducing neodymium oxide to neodymium metal by forming a molten salt bath comprised predominantly of calcium chloride, dispersing a lesser volume of neodymium oxide than the salt bath volume to the bath, adding a stoichiometric excess of calcium metal with respect to the amount of neodymium metal ion to the bath and agitating said bath such that the oxide is reduced to rare earth metal in accordance with the reaction formula $$Nd_2O_3+3Ca \rightarrow 2Nd+CaO.$$

* * * * *